US011220118B2

(12) United States Patent
Barnes et al.

(10) Patent No.: US 11,220,118 B2
(45) Date of Patent: Jan. 11, 2022

(54) MEDIA BIN SENSORS

(71) Applicant: Hewlett-Packard Development Company, L.P., Spring, TX (US)

(72) Inventors: Arthur H Barnes, Vancouver, WA (US); Jody L Clayburn, Vancouver, WA (US); Francisco Javier Gomez Maurer, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 55 days.

(21) Appl. No.: 16/606,620

(22) PCT Filed: Apr. 21, 2017

(86) PCT No.: PCT/US2017/028966
§ 371 (c)(1),
(2) Date: Oct. 18, 2019

(87) PCT Pub. No.: WO2018/194681
PCT Pub. Date: Oct. 25, 2018

(65) Prior Publication Data

US 2021/0114382 A1 Apr. 22, 2021

(51) Int. Cl.

| | |
|---|---|
| ***B41J 11/00*** | (2006.01) |
| ***B41J 13/10*** | (2006.01) |
| ***B65H 1/04*** | (2006.01) |
| ***B65H 7/14*** | (2006.01) |

(52) U.S. Cl.
CPC ..... *B41J 11/0095* (2013.01); *B41J 13/103* (2013.01); *B65H 1/04* (2013.01); *B65H 7/14* (2013.01); *B65H 2511/152* (2013.01); *B65H 2511/22* (2013.01); *B65H 2511/51* (2013.01); *B65H 2511/515* (2013.01); *B65H 2553/414* (2013.01)

(58) Field of Classification Search
CPC ..... B41J 11/0095; B41J 13/103; B65H 1/04; B65H 7/14; B65H 2511/152; B65H 2511/22; B65H 2511/51; B65H 2511/515; B65H 2553/414; B65H 2513/53
See application file for complete search history.

(56) References Cited

U.S. PATENT DOCUMENTS

| | | | |
|---|---|---|---|
| 5,897,112 | A | 4/1999 | Kwag |
| 6,140,662 | A | 10/2000 | Lim et al. |
| 6,794,669 | B2 | 9/2004 | Chelayohan et al. |
| 7,926,896 | B2 | 4/2011 | Chelayohan et al. |
| 9,346,649 | B2 | 5/2016 | Yamashita et al. |

(Continued)

FOREIGN PATENT DOCUMENTS

| | | |
|---|---|---|
| CN | 104070838 | 10/2014 |
| CN | 104102105 | 10/2014 |

(Continued)

OTHER PUBLICATIONS

Kumar, P. et el., Low Power Time-of-flight 3D Imager System in Standard CMOS, Dec. 9-12, 2012, < http://ieeexplore.ieee.org/document/6463506/ ~ 2 pages.

*Primary Examiner* — Yaovi M Ameh
(74) *Attorney, Agent, or Firm* — Mannava & Kang

(57) ABSTRACT

A printing apparatus uses a time of flight sensor to determine distance between the sensor and a surface facing the sensor, and uses a reflectivity value to determine presence of print media in a media bin.

20 Claims, 8 Drawing Sheets

(56) References Cited

U.S. PATENT DOCUMENTS

| | | | | |
|---|---|---|---|---|
| 9,411,278 | B2 | 8/2016 | Yamano et al. | |
| 2003/0098984 | A1* | 5/2003 | Botten | B41J 11/0095 358/1.4 |
| 2009/0317097 | A1* | 12/2009 | Shiraki | G03G 15/6505 399/23 |
| 2010/0044949 | A1 | 2/2010 | Nakamura | |
| 2015/0139670 | A1 | 5/2015 | Ahne et al. | |
| 2016/0176630 | A1* | 6/2016 | Shahabdeen | B65F 1/14 206/459.1 |

FOREIGN PATENT DOCUMENTS

| | | |
|---|---|---|
| CN | 105922768 | 9/2016 |
| JP | S58-110641 U | 7/1983 |
| JP | 2000-147950 | 5/2000 |
| JP | 2000-302292 | 10/2000 |
| JP | 2008-276013 | 11/2008 |
| JP | 2013252914 | 12/2013 |
| JP | 2014-088236 | 5/2014 |
| JP | 2014-101163 | 6/2014 |
| JP | 2015-051519 | 3/2015 |
| WO | WO-2015187125 | 12/2015 |
| WO | WO-2016/100137 A1 | 6/2016 |
| WO | WO-2016093830 | 6/2016 |

* cited by examiner

MEDIA BIN SENSORS

BACKGROUND

Printing and copying devices are used to produce copies of documents. For example, a printing and copying device may obtain media, such as paper, from a media bin and produce an image and/or text onto the paper. The paper with the printed image and/or text may be provided to an output tray of the printing and copying device so that a user may obtain the printed paper from a common output area. Multiple printed sheets may be produced and provided to the output tray for retrieval by a user.

BRIEF DESCRIPTION OF THE DRAWINGS

Features of the present disclosure are illustrated by way of example and not limited in the following figure(s), in which like numerals indicate like elements, in which.

DETAILED DESCRIPTION

Figure 1A:
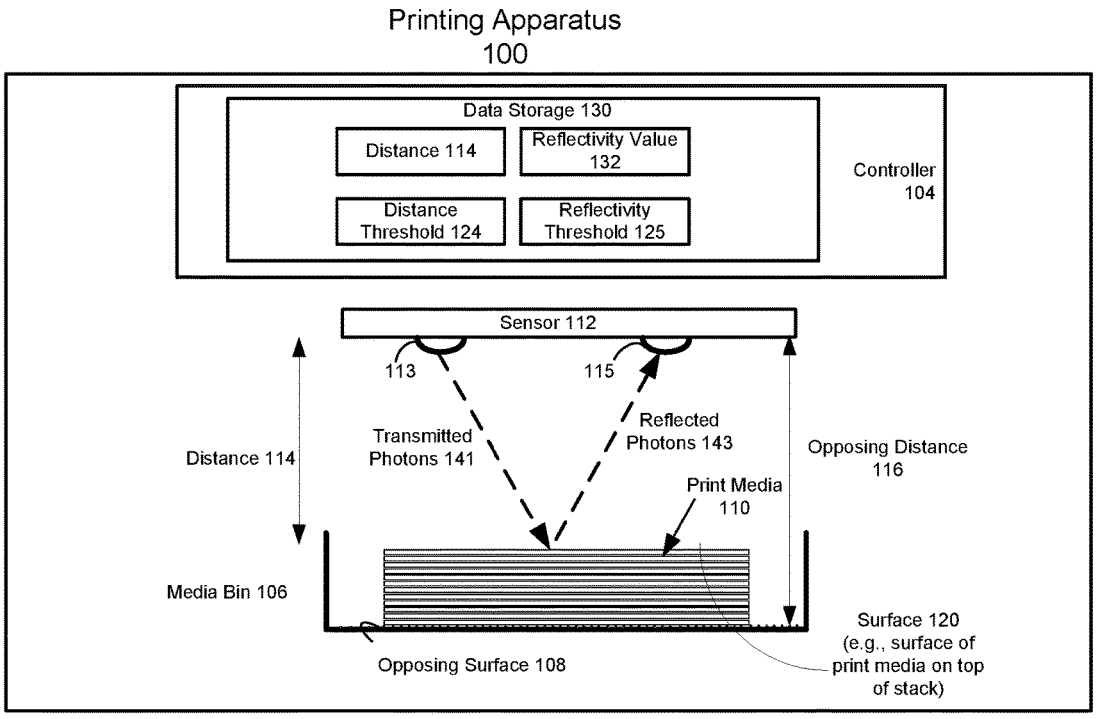
FIG. 1A, FIG. 1B, FIG. 1B'.

For simplicity and illustrative purposes, the present disclosure is described by referring mainly to examples thereof. In the following description, numerous specific details are set forth in order to provide a thorough understanding of the present disclosure. It will be readily apparent however, that the present disclosure may be practiced without limitation to these specific details. In other instances, some methods and structures readily understood by one of ordinary skill in the art have not been described in detail so as not to unnecessarily obscure the present disclosure. As used herein, the terms "a" and "an" are intended to denote at least one of a particular element, the term "includes" means includes but not limited to, the term "including" means including but not limited to, and the term "based on" means based at least in part on.

A printing apparatus, according to an example of the present disclosure, detects the presence of a print media on a media bin or when the media bin is empty using a time of flight sensor, hereinafter sensor. In an example, the sensor may also be an optical sensor. Also, the sensor may be arranged in a media bin assembly to be directed toward the media bin. For example, the sensor may emit photons towards the media bin. The sensor measures the distance between itself and a surface facing the sensor, for example, by measuring the time it takes for light to travel from a transmitter of the sensor to a receiver of the sensor. In an example, the transmitter and receiver may be co-located, such as located on a same plane and/or part of a single sensor. According to an example of the present disclosure, when the measured distance is within a threshold, the sensor may use a reflectivity value of the surface facing the sensor to determine the presence of a print media on the media bin. In an example, the reflectivity value of a surface of the media bin facing the sensor may be different from a reflectivity value of print media that may be on the media bin, and this difference is used in conjunction with the distance threshold comparison to determine whether print media is on the media bin. The surface of the media bin facing the sensor may be referred to as an opposing surface of the media bin.

In an example, the media bin may be a receptacle for holding print media. Print media may include a single sheet or multiple sheets of paper or other types of print media. In an example, the media bin may be a tray for collecting the print media after the printing apparatus produces text and/or images on the print media, such as an output media bin. In an example, the media bin may hold different sizes of the print media. In an example, the media bin may hold print media with a specific gram per square meter thickness (GSM). In another example, the media bin may hold print media of different types such as plain paper, glossy paper, photo paper, etc. In another example, the media bin may be an input media bin that holds the print media prior to printing.

In an example, the sensor may be an optical time of flight sensor that determines the distance between the sensor and the surface facing the sensor, such as the opposing surface of the media bin if the media bin is empty or the surface of print media on the media bin. The distance is measured based on the time it takes for photons transmitted from the sensor to be reflected back to the sensor from the surface facing the sensor. The sensor may be an analog time of flight sensor or a digital time of flight sensor. In addition to measuring distance based on time of flight of the photons, the sensor may also measure the number of received photons per unit time. The received photons include the photons reflected from the surface facing the sensor. In another example, the sensor may measure the number of photons reflected per unit time from the surface, such as number of photons transmitted by the sensor and number of those photons received by the sensor. The sensor may use a particular wavelength of light or may transmit photons in a particular pattern to differentiate between photons transmitted and ambient photons. In an example, the reflectivity value may be the number of photons detected at the sensor per unit time. In another example, the reflectivity value may be number of photons transmitted by and received at the sensor per unit time. In an example, the sensor may include an ambient light detector. In an example, the reflectivity value may be measured using the ambient light detector. The sensor may include an optical transmitter and an optical receiver.

A technical problem associated with the sensor is how to determine whether the media bin has print media on the media bin when the thickness of print media on the media bin is less than a threshold associated with a minimum thickness that can accurately be determined by the distance measurement of the sensor. For example, if the minimum thickness of print media on the media bin the sensor can accurately measure based on the distance measurement is five millimeters (mm), and a single sheet of 80 GSM paper is 0.1 mm (typically ~0.10 mm), the single sheet of 80 GSM paper may not be able to be detected by the distance measurement of the sensor. For example, if the printing apparatus determines the distance measured by the sensor is within a threshold associated with the 5 mm, the printing apparatus may initially consider the media bin to be empty if the thickness of the print media on the media bin is less than 5 mm. The printing apparatus described in further detail below according to examples of the present disclosure is able to accurately determine the presence of a single sheet or multiple sheets of paper on the media bin based on the distance measurement and measured reflectivity value. Accordingly, if a single sheet of paper or multiple sheets of paper having a thickness below a minimum measurable thickness based on a distance measurement is on the media bin, the printing apparatus may be able to detect the single sheet or multiple sheets of papers on the media bin. Furthermore, the printing apparatus may be able to control operations of the printing apparatus, which are further described below, based on the detected print media on the media bin. Another technical problem is associated with the use of contact or mechanical sensors to determine presence of print media on a media bin. The contact or mechanical sensors can damage print media. Also, contact or mechanical sensors are prone to damage when print media is returned to the media bin, such as mechanical flags of the contact or mechanical sensors breaking when print media is returned or put-back. The printing apparatus with the time of flight sensor described in the examples below is able to determine the presence of the print media without using contact sensors or mechanical sensors. Also, the sensors in the printing apparatus in the example described below are not damaged when print media is removed from the media bin and placed back on the media bin. Furthermore, the printing apparatus is able to determine when print media is removed from the media bin and placed back on the media bin.

With reference to FIG. 1A, there is shown a block diagram of a printing apparatus 100, referred to hereinafter as apparatus 100, according to an example of the present disclosure. The apparatus 100 may include a media bin 106 for holding print media 110. The apparatus 100 may include a controller 104 for controlling a sensor 112. The sensor 112 may be directed toward the media bin 106. For example, the sensor 112 may output photons toward the media bin 106, shown as transmitted photons 141, and receive reflected photons 143, which are further discussed below. As shown in FIG. 1A, the media bin 106 holds the print media 110, e.g., multiple sheets of paper, and the transmitted photons 141 are directed toward a surface 120, such as the surface of a print media held on the media bin 106. In other examples described below, the surface 120 may be an opposing surface 108 of the media bin 106, when the media bin 106 is empty. The opposing surface 108 faces the sensor 112 and may reflect the transmitted photons 141 if the media bin 106 is empty, such as discussed below. The opposing surface 108 is shown with ridges to distinguish the opposing surface 108 from other surfaces, but the opposing surface 108 may be flat.

The controller 104 may determine the distance 114 between the sensor 112 and the surface 120. In an example, the controller 104 may determine the distance 114 based on the time of flight for photons transmitted from the sensor 112 and received back at the sensor 112 after reflection from the surface 120. For example, the reflected photons 143 are photons of the transmitted photons 141 that are reflected back to the sensor 112. The controller 104 may determine whether the distance 114 measured between the sensor 112 and the surface 120 is within a distance threshold 124. In an example, the distance threshold 124 may be based on an opposing distance 116 between the sensor 112 and the opposing surface 108. For example, the distance threshold may be 99% of the opposing distance 116 or another percentage of the opposing distance 116. When the distance 114 is within the distance threshold 124, the controller 104 may consider the media bin 106 empty. To confirm whether the media bin 106 is empty, the controller 104 may determine the reflectivity value 132 of the surface 120, based on the number of photons reflected by the surface 120 and received back at the sensor 112. The reflectivity value 132 may be measured by the sensor 112. The controller 104 may determine whether the print media 110 is present on the media bin 106 by comparing the measured reflectivity value 132 to the reflectivity threshold 125. For example, reflectivity threshold 125 may be equal to a media reflectivity value of the print media 110. In an example, the media reflectivity value of the print media 110 may be the average reflectivity of the print media 110. Accordingly, if the reflectivity value 132 measured by the sensor 112 is equal to or approximately equal to (e.g., within a predetermined tolerance) the reflectivity threshold 125, then the presence of the print media 110 is detected. In an example, the controller 104 may compare the reflectivity value 132 to the reflectivity threshold 125. And, based on the comparison the controller 104 may determine whether the print media 110 is on the media bin 106.

In an example, the media bin 106 may hold the print media 110 before the apparatus 100 prints images and/or text on the print media 110. In an example, the media bin 106 may hold the print media 110 after the apparatus 100 prints images and/or text on the print media 110. In an example, the media bin 106 may hold a stack of print media 110.

In an example, the sensor 112 may be a time of flight sensor. The sensor 112 may include an optical transmitter 113 that can transmit the transmitted photons 141 and an optical receiver 115 that can receive the reflected photons 143. In an example, the sensor 112 may determine the distance to the surface 120 using a laser transmitter and time of flight of the laser received at a laser receiver on the sensor 112 after reflection from the surface 120. In an example, the sensor 112 may determine the distance 114 using the number of photons transmitted by sensor 112 and the number of photons received by sensor 112 integrated over a period of time. In an example, the sensor 112 may determine the distance 114 using an outgoing beam transmitted by the optical transmitter 113 of photons modulated with a Radio Frequency (RF) carrier and then measuring the phase shift of that carrier when received by the optical receiver 115 of the sensor 112 after reflection from the surface 120. In an example, the sensor 112 may determine the distance 114 using a range gated imager that opens and closes at the same rate as the photons set out. In the range gated imager, a part of the returning photons are blocked according to time of arrival. Thus, the number of photons received relates to the distance traveled by the photons. The distance traveled can be calculated using the formula, $z=R(S_2-S_1)/2(S_1+S_2)+R/2$, where R is the sensor range, determined by the round trip of the light pulse, $S_1$ is the amount of light pulse that is received, and $S_2$ is the amount of the light pulse that is blocked. In an example, the sensor 112 may measure the direct time of flight for a single laser pulse to leave the sensor 112 and reflect back onto a focal plane array of the sensor 112. The sensor 112 may use InGaAs avalanche photo diode or photodetector arrays capable of imaging laser pulse in the 980 to 1600 nm wavelengths. In an example, sensor 112 may include an illumination unit for illuminating the scene, an optical unit to gather the reflected light, an image sensor where a pixel measures the time the light has taken to travel from the illumination unit to the object and back to the focal plane array and driver electronics. In an example, the illumination unit may include a laser diode or an infrared led. In an example, the optical unit of sensor 112 may include an optical band-pass filter to pass light with the same wavelength as the illumination unit to suppress non-pertinent light and reduce noise of the light received. In an example, sensor 112 may include an ambient light sensor to determine a signal to noise ratio, between the light received by the sensor 112 which was transmitted from sensor 112 and the light received by the sensor 112 which is ambient light.

In an example, the controller 104 may include data storage 130. The data storage 130 may store at least one of the distance 114, the opposing distance 116, the reflectivity value 132, the reflectivity threshold 125 and the distance threshold 124. As discussed above, the reflectivity threshold 125 may be compared with the reflectivity value 132 of the surface 120, which is measured by the sensor 112, to detect the presence of the print media 110. In an example, the reflectivity threshold 125 may be based on the opposing surface reflectivity value such as 98% to 102% of the opposing surface reflectivity value. The measured reflectivity value 132 may be within the reflectivity threshold 125, when the measured reflectivity value 132 is within the opposing surface reflectivity value such as 98% to 102% of the opposing surface reflectivity value. In another example, the reflectivity value 132 may be within the reflectivity threshold 125, when the measured reflectivity value 132 is outside the reflectivity threshold 125. In an example, the opposing surface reflectivity value may be measured as an average of the measurements of the sensor 112 when the apparatus 100 is initialized. In another example, the reflectivity threshold 125 may be predetermined.

In an example, the distance threshold 124 may be a percentage of the opposing distance 116, such as 98% to 102% of the opposing distance 116. The distance 114 measured by the sensor 112 may be within the distance threshold 124 in this example, when the distance 114 is within 98% to 102% of the opposing distance 116. In another example, the distance threshold 124 may be based on the minimum effective distance the sensor 112 can measure. In this example, the distance 114 measured by the sensor is within the distance threshold 124 when the distance 114 is within distance 116 plus or minus the minimum effective distance. In another example, the distance 114 measured by the sensor is within the distance threshold 124 when the distance 114 is within distance 116 plus or minus the minimum effective distance.

Figure 1B:
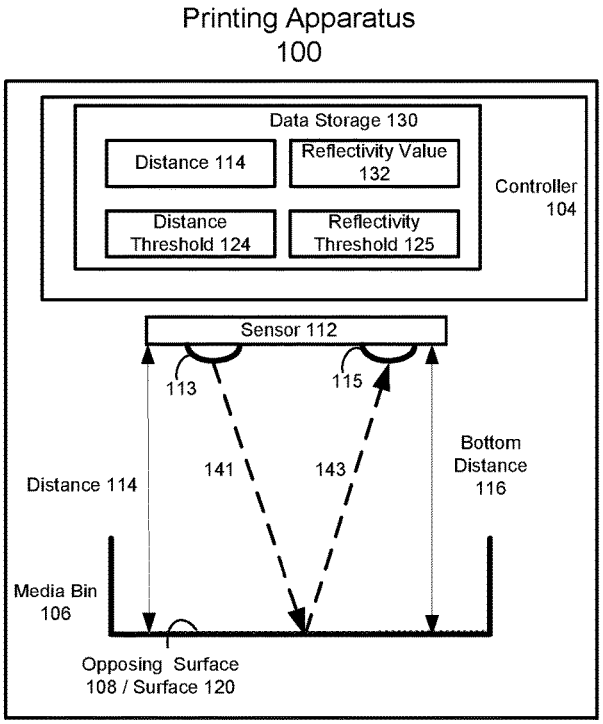
Figure 1B:
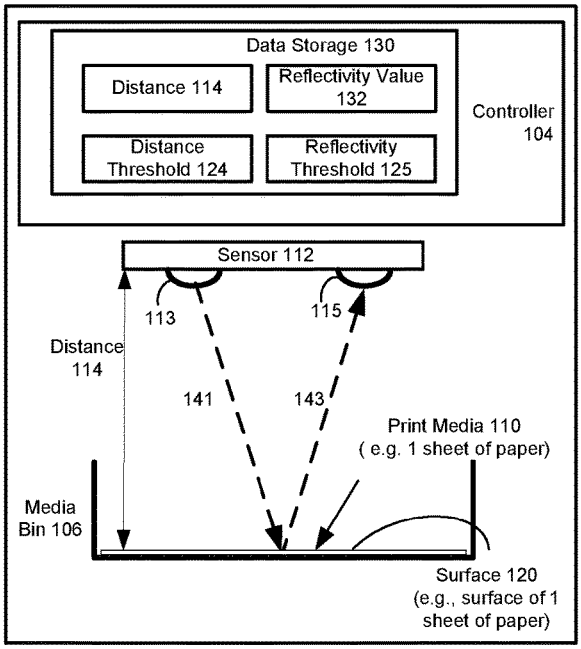
Figure 1C:
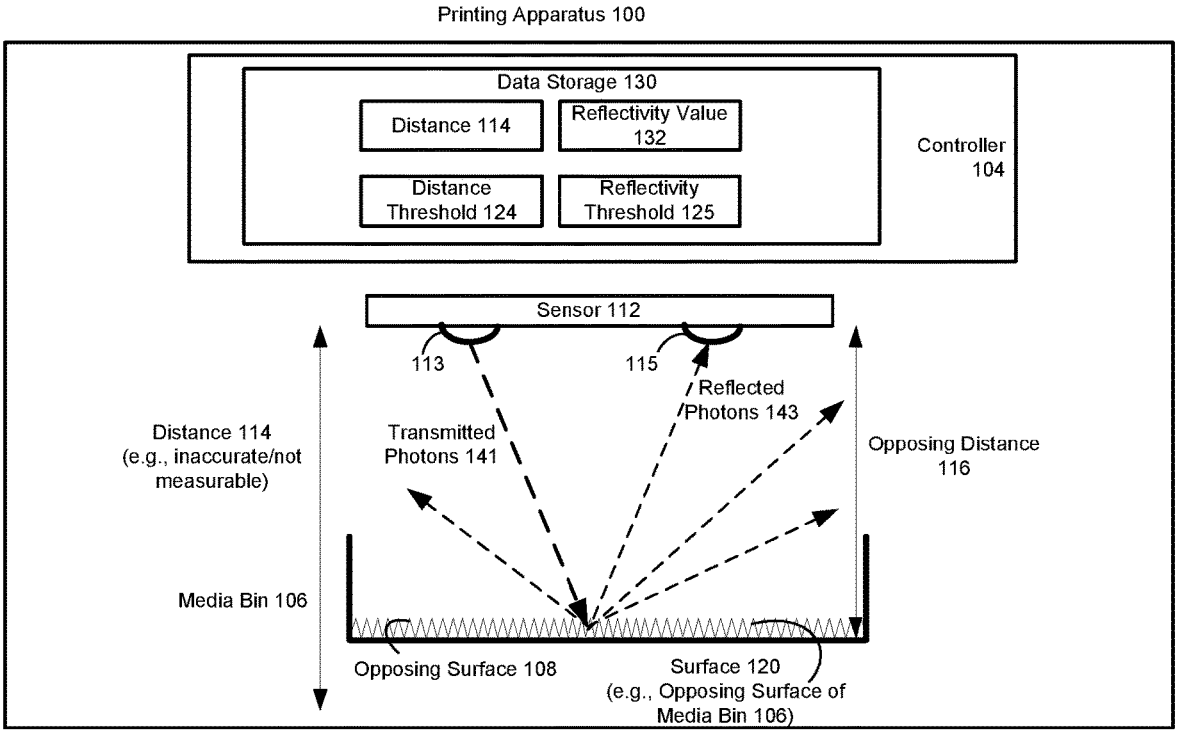
FIG. 1C and FIG. 1D show block diagrams of an example printing apparatus including a media bin.

With reference to FIG. 113 and FIG. 1B', these figures show instances whereby the media bin 106 may initially be considered empty based on the distance measurement. For example, FIG. 1B shows no print media present in the media bin 106 and FIG. 1B' shows a single sheet of print media present in the media bin 106. In FIG. 1B, when the measured reflectivity value 132 is compared to the threshold, the controller 104 may verify the media bin 106 is empty. In FIG. 1B', when the measured reflectivity value 132 is compared to the threshold, the controller 104 may determine that the media bin 106 contains print media even though the print media 110 has a thickness of less than the minimum effective distance measurement of the sensor 112.

A reflectivity value of the opposing surface 108 is referred to as the opposing reflectivity value. In an example, the opposing reflectivity value is higher than the media reflectivity value of the print media 110, and thus, the print media 110 and the opposing surface 108 may be differentiated by the controller 104 based on sensor measurements. The opposing reflectivity value may be the average measured reflectivity of the opposing surface 108. The opposing reflectivity value may be used to determine the reflectivity threshold 125. In another example, the opposing reflectivity value is lower than the media reflectivity value of the print media 110, and thus, the print media 110 and the opposing surface 108 may be differentiated by the controller 104 based on sensor measurements. Examples of the opposing surface 108 may include a mirror layer such as 3M™ daylighting film, a carbon black layer, replaceable layers, or painted layers or a coating on the opposing surface 108.

The controller 104 may measure and store the opposing reflectivity value on the data storage 130 when the print media 110 is not present on the media bin 106 to initially determine the reflectivity threshold 125. This can be done during a calibration process. The opposing reflectivity value may change over time such as due to wear, and the opposing reflectivity value may be periodically measured, such as before the print media 110 is transported to the media bin 106. The controller 104 may calculate the reflectivity threshold 125 based on the media reflectivity value of the print media 110. For example, the reflectivity threshold 125 may be set to a percentage of the media reflectivity value of the print media 110.

In an example, print media 110 may be of different types such as plain paper, photo paper, glossy paper, cardstock, paper of different thickness or GSM, etc. Different types of the print media 110 may have different reflectivity values. In another example, the print media 110 may have different reflectivity values for the same type of media manufactured by different manufacturers. In another example, print media 110 may have different reflectivity values, based on the content printed such as text, photos, solid filled areas from power point slides, etc. In an example, the controller 104 may have predetermined media reflectivity value look up tables for print media 110 of different types.

In an example, the controller 104 may store the media reflectivity value of the last-printed print media 110. The media reflectivity value of the last-printed print media 110 may be used to determine whether the last-printed print media 110 has been removed and then replaced in the media bin 106.

In an example, the controller 104 may determine the minimum effective value of the sensor 112 using the number of printed sheets, and calculating the distance 114 as each sheet is printed. When the distance 114 is determined to be different from the distance 116 as each sheet printed, that distance is the minimum effective value of the sensor 112.

Figure 1D:
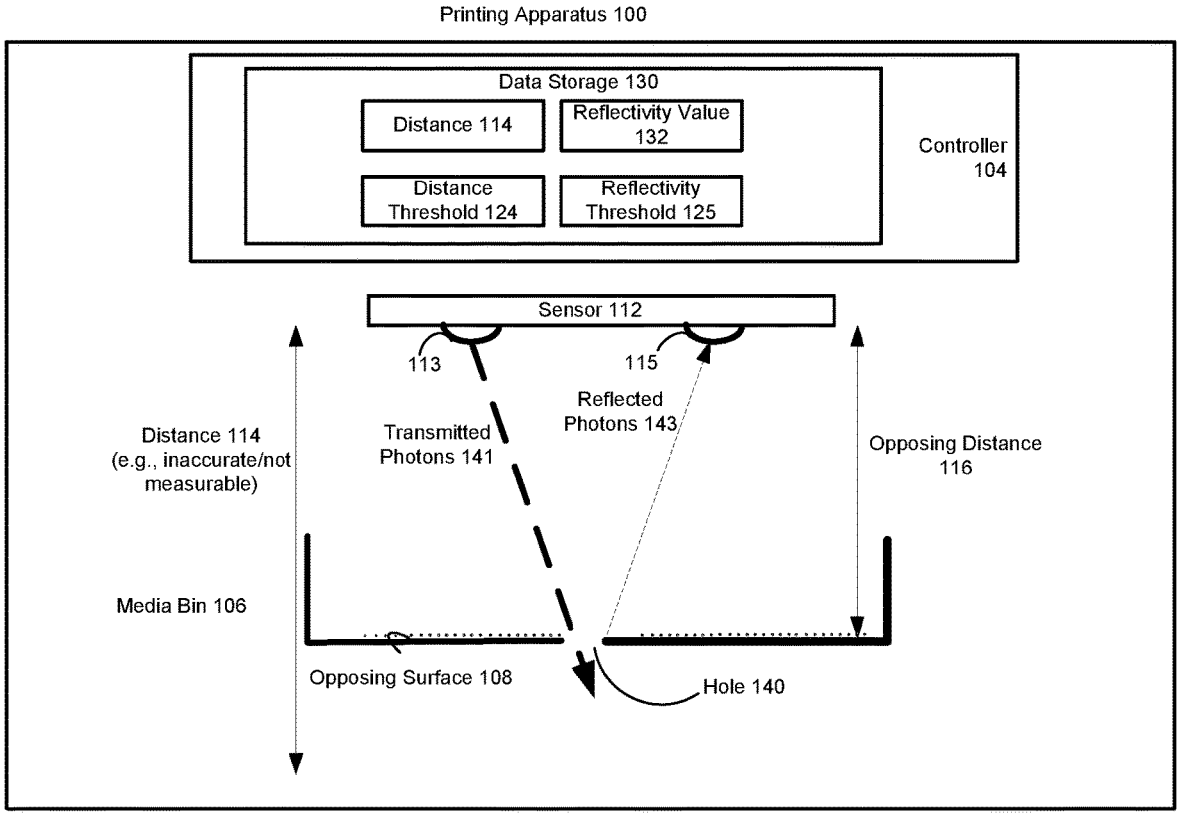

FIG. 10 shows an example whereby the opposing surface 108 reflects the transmitted photons 141 away from the optical receiver 115 of the sensor 112. For example, the opposing surface 108 includes a grating to scatter the transmitted photons 141, as illustrated. This is another technique to facilitate making the reflectivity value of the opposing surface 108 different from the print media 110. In another example, the opposing surface 108 may be made to be absorbent of the transmitted photons 141 to make the reflectivity value of the opposing surface 108 different from the print media 110. FIG. 1D shows yet another example to distinguish the reflectivity value of the opposing surface 108. For example, the opposing surface 108 may include a hole 140 aligned with the optical transmitter 113 to minimize the reflected photons 143.

Figure 2A:
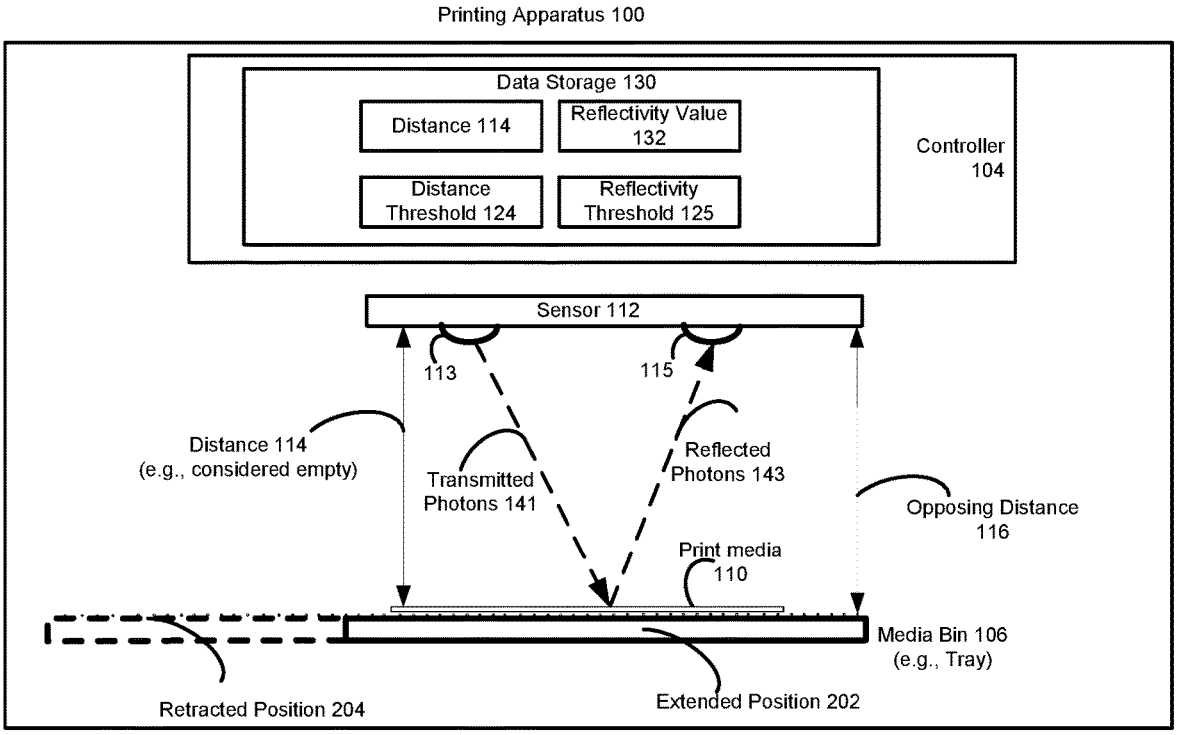
FIG. 2A and FIG. 2B show block diagrams of an example printing apparatus including a media bin with a translatable media bin.
Figure 2B:
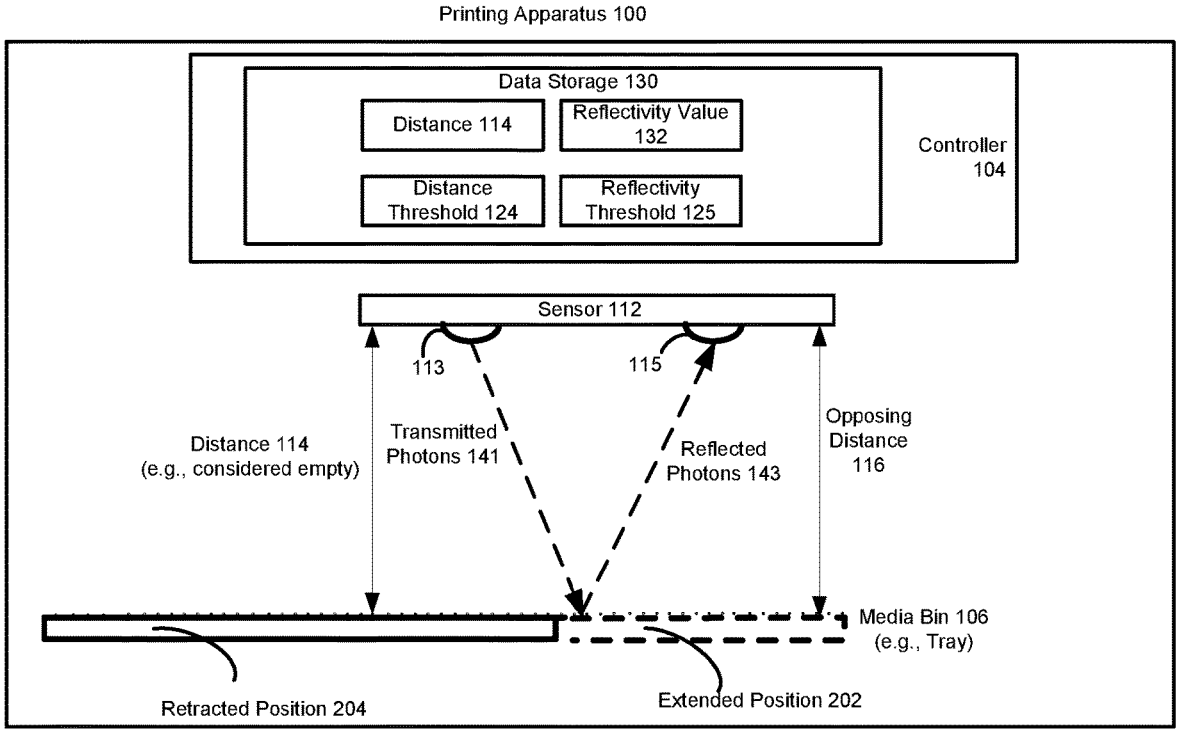

With reference to FIG. 2A and FIG. 2B, the media bin 106 may be laterally translatable between an extended position 202 and a retraced position 202. For example, FIG. 2A shows the media bin 106 in the extended position 202. The controller 104 may extend the media bin 106 to the extended position 202 when print media 110 is printed to the media bin 106. FIG. 2B shows the media bin 106 in the retracted position 204. The controller 104 may retract the media bin 106 to the retracted position 204 when print media 110 is removed from the media bin 106. The media bin 106 may be a finisher tray and may be laterally translated between the extended position 202 and retraced position 204 based on whether the reflectivity value 132 of the surface 120 is within the reflectivity threshold 125. In an example, the print media 110 may be picked up and replaced on the media bin 106, preventing the media bin 106 from being retracted to the retracted position 204. In an example, the controller 104 may communicate an alert when the media bin 106 is not empty, such as when the media bin is a finisher tray in the extended position 202. In another example, the controller 104 may communicate an alert when the media bin 106 is empty, such as when the media bin 106 is an input bin.

Figure 3A:
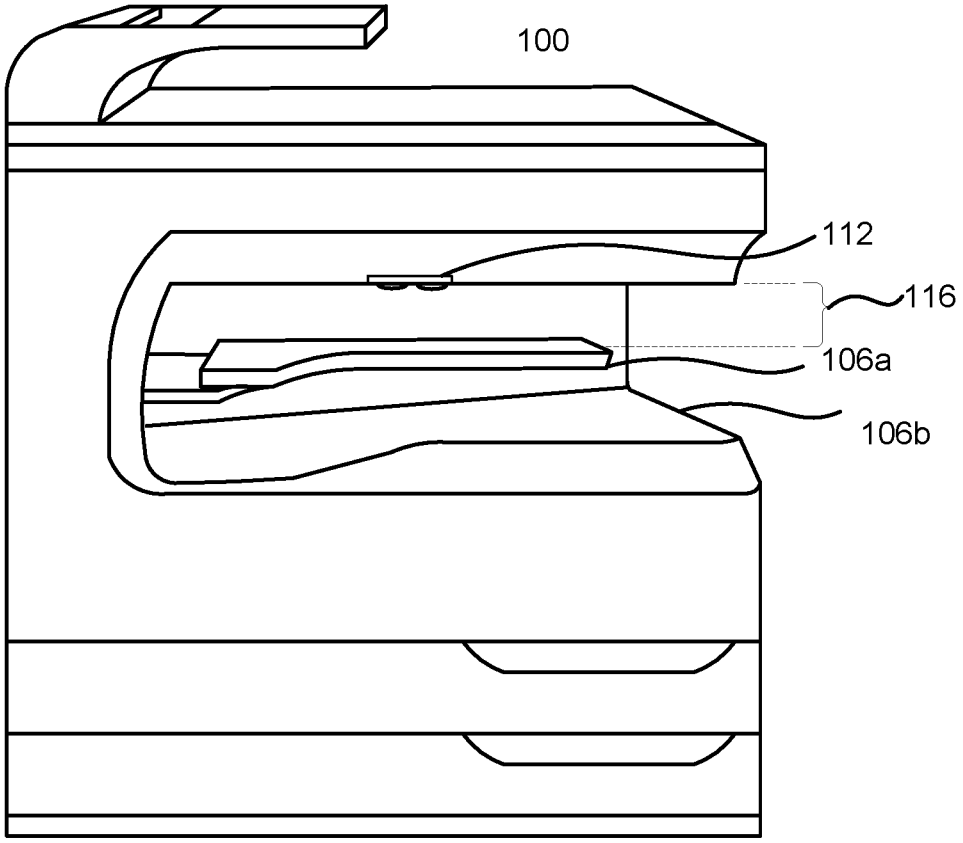
FIGS. 3A, 3C and 3D shows side views of an example printing apparatus.
Figure 3B:
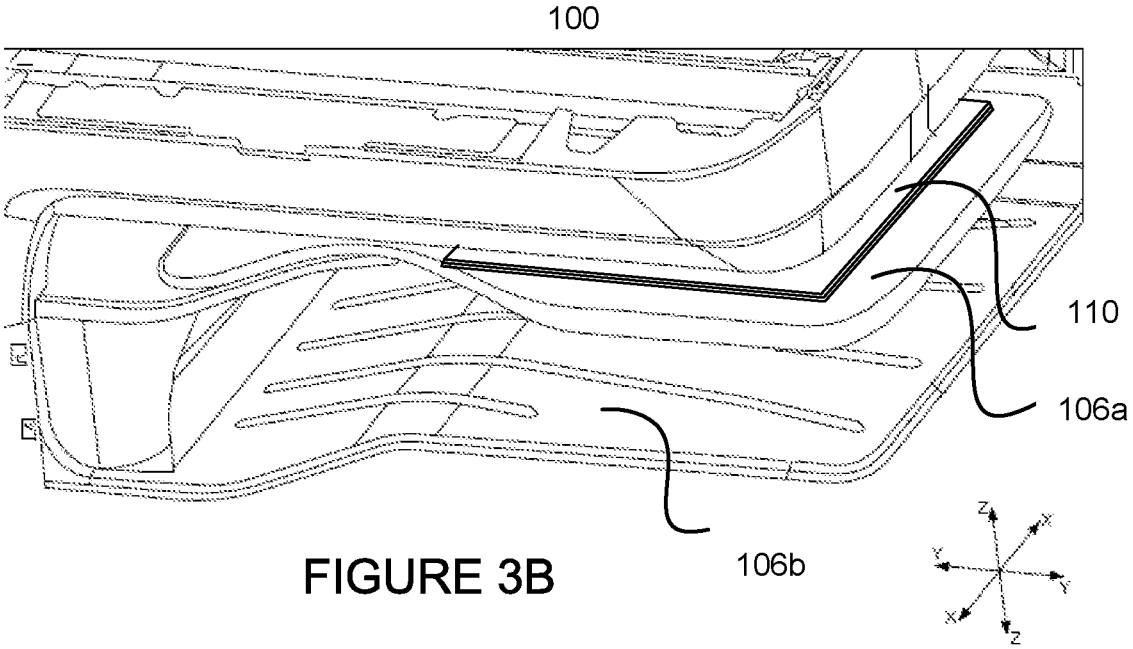
FIG. 3B shows an isometric view of the printing apparatus having a laterally translating media bin.
Figure 3C:
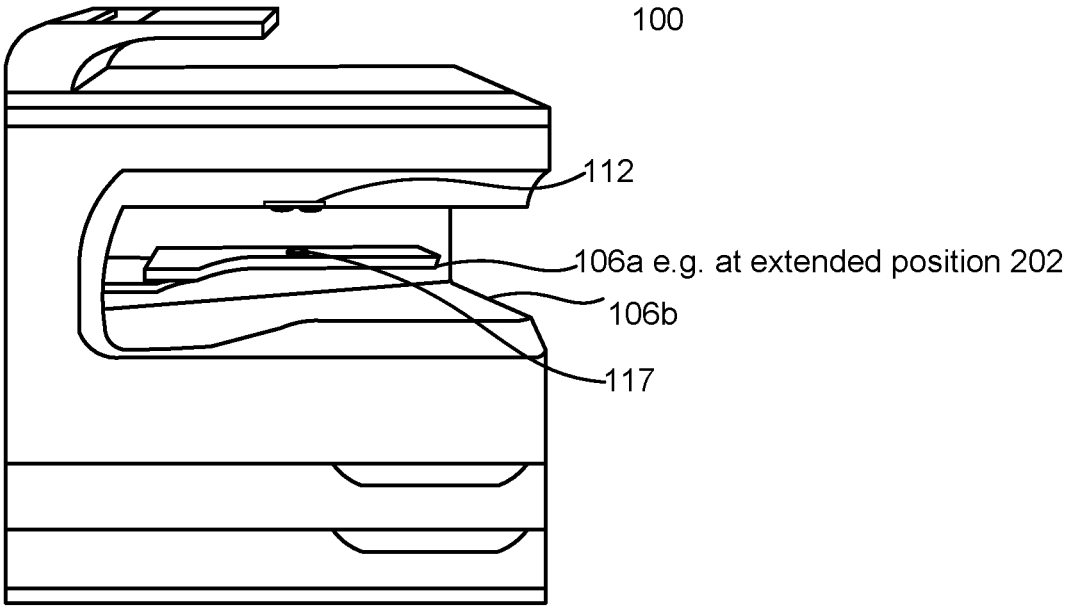
Figure 3D:
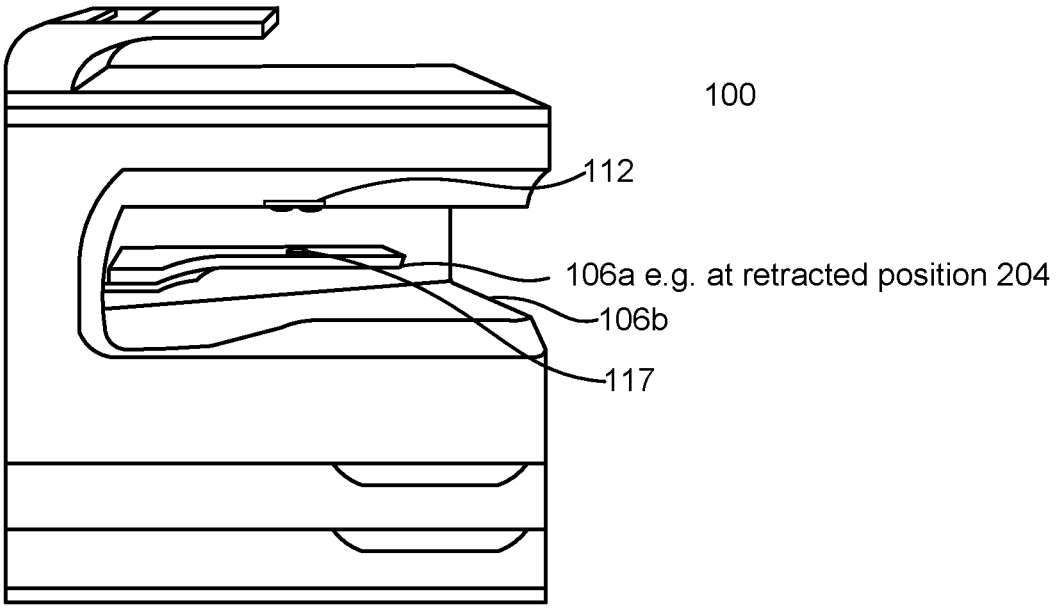

FIGS. 3A, 3C and 3D are side views of the printing apparatus 100, according to an example. FIG. 3B is an isometric view of the printing apparatus 100, according to an example. FIG. 3A shows two media bins, labeled 106*a* and 106*b*. The media bin 106*a* may be retractable, such as discussed above, to provide easier access to the media bin 106*b*. In an example, with reference to FIGS. 2A, 2B, 3C and 3D the media bin 106*a* may translate from the extended position 202 to the retracted position 204. The media bin 106*a* may be located at the opposing distance 116 from the sensor 112. In an example, with reference to FIG. 3B the media bin 106*a* may translate from the extended position 202 to the retracted position 204 along the Y-Y axis of FIG. 3B. In another example, with reference to FIG. 3B the media bin 106*a* may translate along the X-X axis of FIG. 3B. In another example, with reference to FIG. 3B the media bin 106*a* may translate along the X-X axis of FIG. 3B. In another example, with reference to FIG. 3B the media bin 106*a* may translate along a combination of X-X and Y-Y axis of FIG. 3B. In an example, the controller 104 may leave the media bin 106*a* in the extended position 202 when the media bin 106*a* is not empty. In another example, the controller 104 may retract the media bin 106*a* when empty.

Figure 3E:
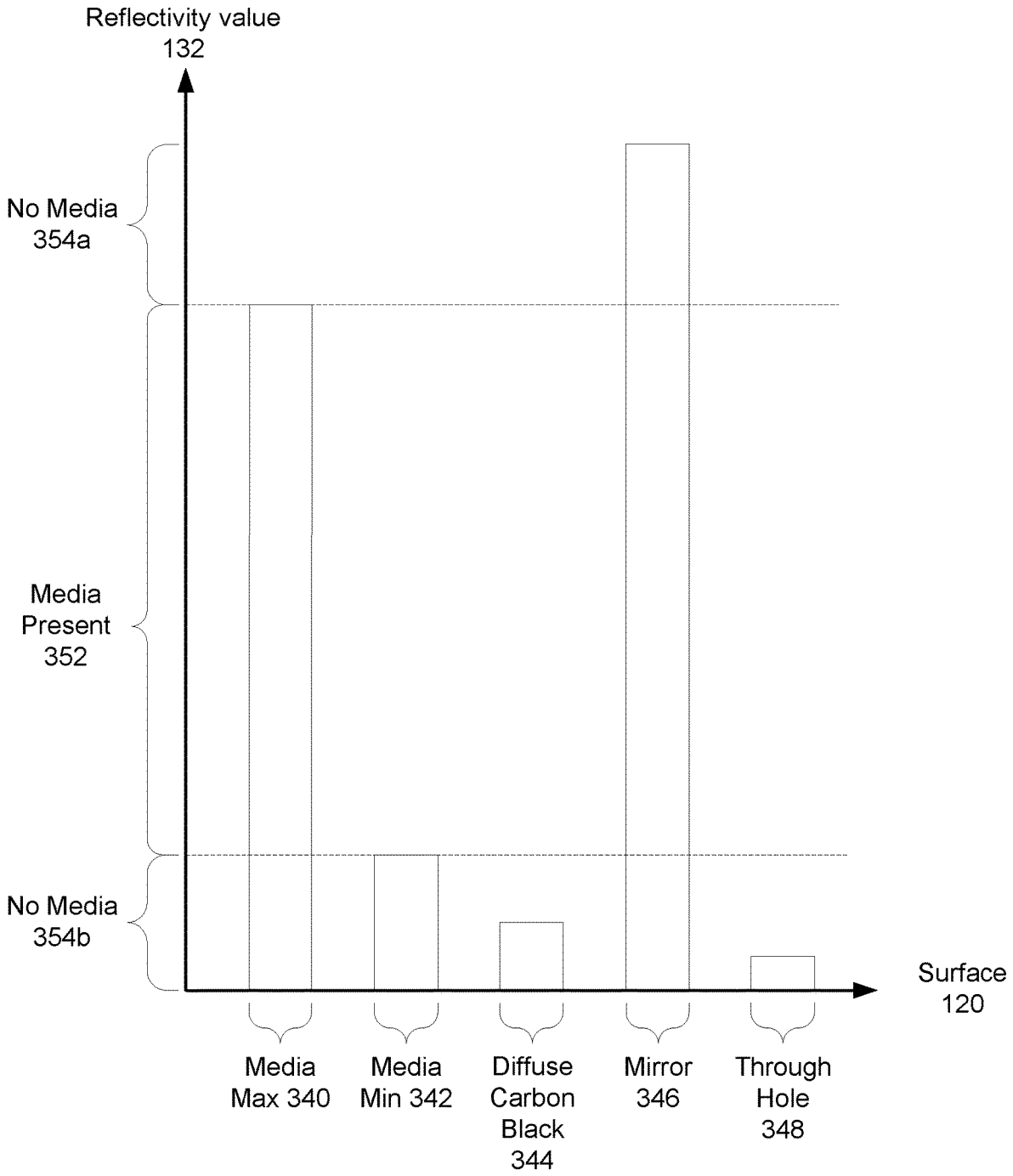
FIG. 3E shows an example histogram of reflectivity values.

FIG. 3E shows a histogram of reflectivity values for surface 120 according to examples of the present disclosure. In an example, the histogram depicts the reflectivity value 132 of surface 120, facing the sensor 112. In an example, print media 110 may different reflectivity values based on the type such a glossy, plain, photo, etc., the manufacturer, content printed such as text, photos, solid filed areas from power point slides, etc. In an example, the print media 110 on the media bin 106 may have a maximum reflectivity value 340 and a minimum reflectivity value 342 as shown in the histogram. In an example, the controller 104 may determine presence of media 352 on the media bin 106, when the reflectivity value 132 measured by the sensor 112 is between the maximum reflectivity value 340 and the minimum reflectivity value 342. In another example, the controller 104 may determine absence of media 354*a*, 354*b* on the media bin 106, when the reflectivity value 132 measured by the sensor 112 is below the minimum reflectivity value 342 or above the maximum reflectivity value 340 of the print media 110.

In an example, the opposing surface 108 of the media bin 106 may be a diffuse black surface. The diffuse carbon black surface may have a reflectivity value 344 as shown in the histogram, which may be lower than the minimum reflectivity value 342 of the print media 110. In another example, the opposing surface 108 of the media bin 106 may include a through hole aligned with the sensor 112. The through hole may have a reflectivity value 348, which may be lower than the minimum reflectivity value 342 of the print media 110. In another example, a mirror surface 346 may have a reflectivity value 348, which may be higher than the maximum reflectivity value 340 of the print media 110. In an example, the controller 104 may determine presence 352 or absence 354*a*, 354*b* of the print media 110 based on the difference in reflectivity values between the print media 110 and the opposing surface 108 of the media bin 106.

Figure 4:
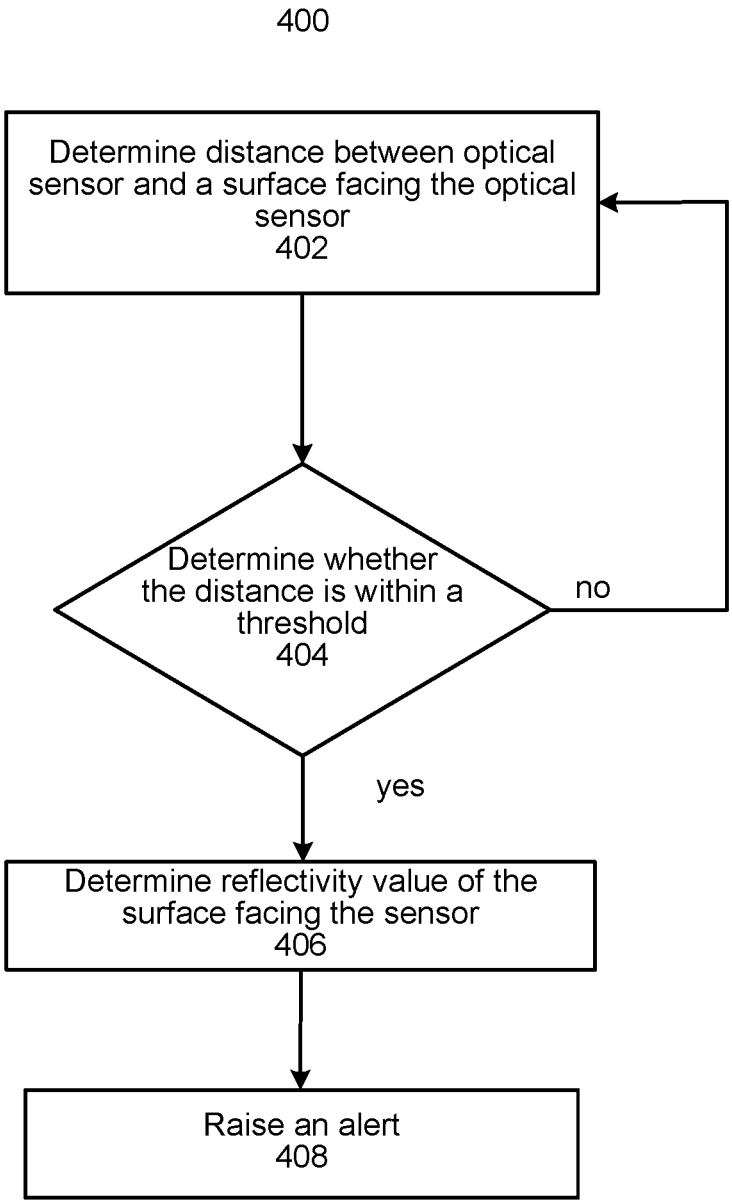
FIG. 4 shows a flow chart of an example method for detecting print media.

FIG. 4 shows an example of a method 400. The method 400 may be performed by the apparatus 100 to determine whether the media bin 106 is empty or to determine whether the print media 110 is present in the media bin 106. The method 400 is described by way of example as being performed by the apparatus 100, and may be performed by other apparatus. The method 400 and other methods described herein may be performed by any printing apparatus including at least one processor executing machine readable instructions embodying the method. For example, the apparatus 100 and/or the controller 104 shown in FIG. 1 may store machine readable instructions in the data storage 130 embodying the methods, and a processor in the controller 104 may execute the machine readable instructions. Also, one or more of the steps of the method 400 and steps of other methods described herein may be performed in a different order than shown or substantially simultaneously.

At 402, the apparatus 100 determines the distance 114 between the time of flight sensor 112 and the surface 120 facing the sensor 112. In an example, the controller 104 may calculate the distance 114 based on the time taken by photons transmitted from the sensor 112 and received by the sensor 112 and reflected from the surface 120.

At 404, the apparatus 100 determines whether the distance 114 is within the threshold 124. For example, the distance threshold 124 may be based on the opposing distance 116 between the sensor 112 and the opposing surface of a media bin 106, e.g. 98% to 102% of the opposing distance 116. The apparatus 100 proceeds to 406 when the distance 114 is within the threshold 124. The apparatus 100 proceeds to 402 otherwise.

At 406, the apparatus 100 determines the reflectivity value 132 of the surface 120. In an example, the reflectivity value 132 of the surface 120 may be measured based on the number of photons transmitted and reflected back to the sensor 112 per unit time.

At 408, the apparatus 100 raises an alert based on a reflectivity value of the surface 120. For example, when a reflectivity value measured matches the media reflectivity value of the surface 120 of apparatus 100, the alert may be raised to ensure removal of the print media 110 on the media bin 106 after the apparatus 100 has completed the pages in a print job. In an example, when the apparatus 100 may raise an alert when the media bin 106 is used to store print media 110 before image and/or text is printed on the print media 110, to indicate the media bin 106 is empty. In another example the alert may be raised to indicate the media bin is almost empty. In another example, the alert is not raised when the media bin has print media 110.

Figure 5:
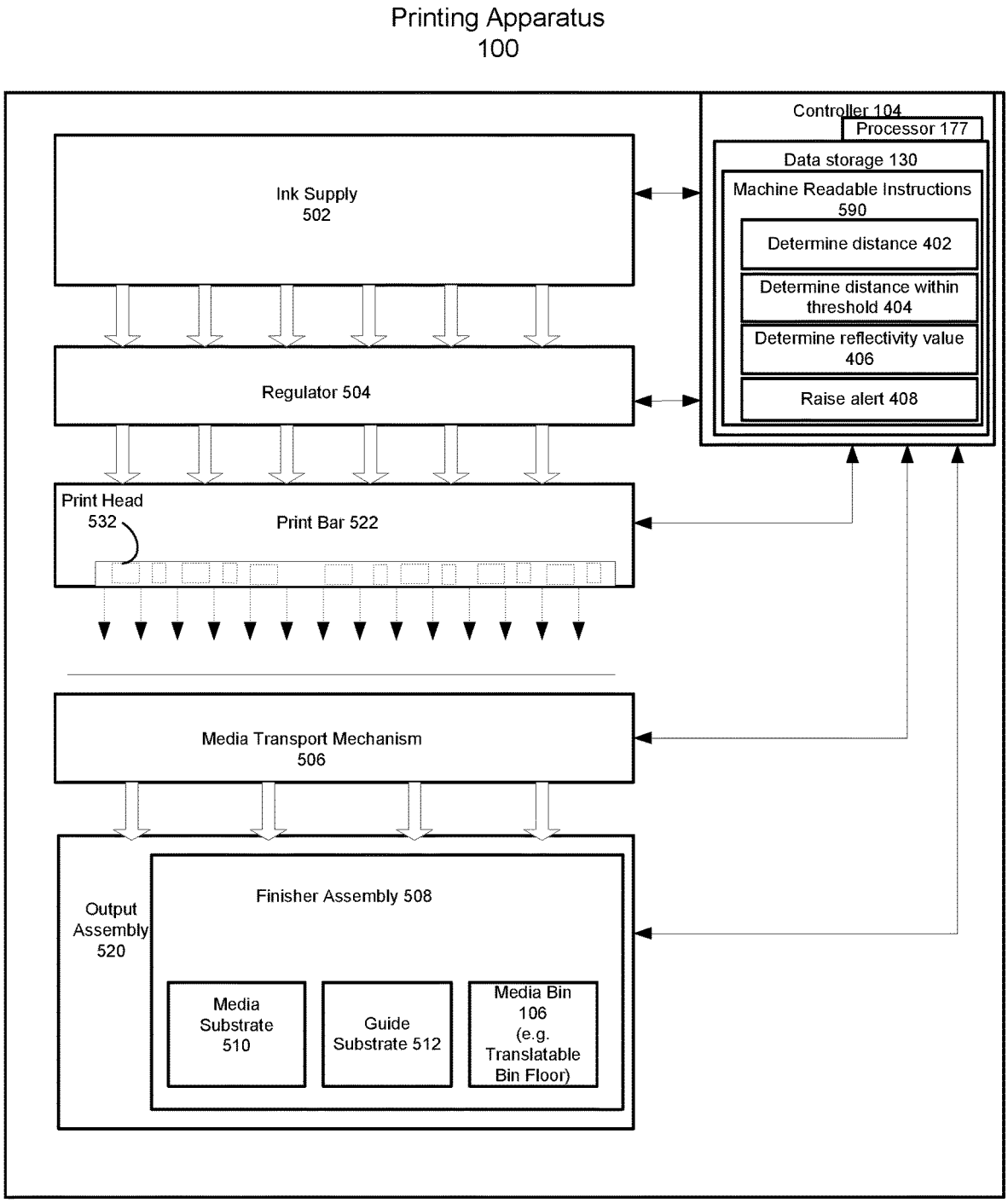
FIG. 5 shows components that may be used in the example printing apparatuses described herein.

FIG. 5 shows a block diagram of the printing apparatus 100 including the media bin 106, according to an example of the present disclosure. The apparatus 100 includes the media bin 106 to receive the print media 110. In an example, the apparatus 100 may receive a number of stacks of the print media 110. In another example, the apparatus 100 may include a print bar 522 that spans the width of the print media 110. In another example, the apparatus 100 may include non-page wide array print heads. The apparatus 100 may further include flow regulators 504 associated with the print bar 522, a media transport mechanism 506, printing fluid or other ejection fluid supplies 502, and the controller 104. Although a 2D printing apparatus is described herein and depicted in the accompanying figures, aspects of the examples described herein may be applied in a 3D printing apparatus.

The controller 104 may represent the machine readable instructions 590, processor(s) 177, associated data storage device(s) 130, and the electronic circuitry and components used to control the operative elements of the apparatus 100 including the firing and the operation of print heads 532, including the print bar 522. The controller 104 is hardware such as an integrated circuit, e.g., a microprocessor. In other examples, the controller 104 may include an application-specific integrated circuit, field programmable gate arrays or other types of integrated circuits designed to perform specific tasks. The controller 110 may include a single controller or multiple controllers. The data storage 130 may include memory and/or other types of volatile or nonvolatile data storage devices. The data storage 130 may include a non-transitory computer readable medium storing machine readable instructions 590 that are executable by the controller 104. In an example, the controller 104 may retrieve the machine readable instructions 590 from the data storage 130 to execute the instructions. At 402, the controller 104 may determine the distance 114 between the time of flight sensor 112 and the surface 120. At 404, the controller 104 may determine distance 114 is within a threshold 114. At 406, the controller 104 may determine whether the reflectivity value 132 of the surface facing the sensor 112. At 408, the controller 104 may raise an alert based on the reflectivity value 132 of the surface. In another example, the controller may determine translate the media bin 106 using the finisher assembly 508 based on the determination.

Further, the controller 104 controls the media transport mechanism 506 used to transport media through the apparatus 100 during printing and to transport the print media 110 to the media bin 106. In an example, the controller 104 may control a number of functions of the media bin 106. In one example, the controller 104 may control a number of functions of the media bin 106 in presenting the print media 110 to a media bin 106 such as a translatable bin floor. Further, the controller 104 controls functions of a finisher assembly 508 to translate a number of stacks of the print media 110 between a number of different locations within the output area.

The media transport mechanism 506 may transport the print media 110 from the media bin (not shown in figure) for feeding paper into the printing apparatus 100 to the output assembly 520 used for collection, registration and/or finishing of the print media 110. In an example, the print media 110 collected on the output assembly 520 includes at least one of the print media 110 having text and/or images produced. In an example, a completed collection of the print media 110 may represent a print job that the apparatus 100 processes.

The apparatus 100 may be any type of device that reproduces an image onto the print media 110. In one example, the apparatus 100 may be an inkjet printing device, laser printing device, a toner based printing device, a solid ink printing device, a dye-sublimation printing device, among others. Although the present printing apparatus 100 is describe herein as an inkjet printing device, any type of printing apparatus may be used in connection with the described systems, devices, and methods described herein. Consequently, an inkjet printing apparatus 100 as described in connection with the present specification is meant to be understood as an example and is not meant to be limiting.

What has been described and illustrated herein are examples of the disclosure along with some variations. The terms, descriptions and figures used herein are set forth by way of illustration only and are not meant as limitations. Many variations are possible within the scope of the disclosure, which is intended to be defined by the following claims—and their equivalents—in which all terms are meant in their broadest reasonable sense unless otherwise indicated.

What is claimed is:

1. A printing apparatus comprising:

a media bin;

an optical sensor arranged to transmit photons toward the media bin and receive the photons reflected from the media bin;

a controller to:

determine a distance between a surface facing the optical sensor and the optical sensor based on a time of flight for the photons transmitted and received back at the optical sensor after reflection from the surface;

determine whether the media bin is considered empty based on a distance threshold and the determined distance, wherein the distance threshold is based on a distance between the optical sensor and an opposing side of a media bin facing the optical sensor;

determine a reflectivity value of the surface facing the optical sensor when the determined distance is within the distance threshold; and determine whether at least one print media is on the media bin based on the reflectivity value of the surface.

2. The printing apparatus of claim 1, wherein when the at least one print media is not on the media bin, the surface facing the optical sensor is an opposing surface of the media bin facing the optical sensor.

3. The printing apparatus of claim 2, wherein an opposing reflectivity value of the opposing surface of the media bin is higher than a media reflectivity value of the at least one print media.

4. The printing apparatus of claim 2, wherein an opposing reflectivity value of the opposing surface of the media bin is lower than a media reflectivity value of the at least one print media.

5. The printing apparatus of claim 2, wherein the opposing surface of the media bin reflects the photons away from the optical sensor to alter a number of photons received by the optical sensor.

6. The printing apparatus of claim 2, wherein the opposing surface of the media bin includes a hole aligned with the optical sensor to alter a number of photons reflected toward the optical sensor.

7. The printing apparatus of claim 2, wherein the opposing surface of the media bin includes a mirror layer facing the optical sensor.

8. The printing apparatus of claim 2, wherein the opposing surface of the media bin includes a carbon black layer facing the optical sensor.

9. The printing apparatus of claim 1, wherein the controller further comprises:

a memory; and wherein the controller, to determine presence of the at least one print media, stores a media reflectivity value of the at least one print media when the at least one print media is first placed on the media bin in the memory and compares the reflectivity value of the surface facing the optical sensor to the media reflectivity value.

10. The printing apparatus of claim 1, wherein the controller further comprises:

a memory; and wherein the controller, to determine presence of the at least one print media, stores an opposing reflectivity value of an opposing surface of the media bin when print media is not present on the media bin in the memory.

11. The printing apparatus of claim 1, wherein the reflectivity value is based on number of reflected photons received back at the optical sensor per unit time.

12. The printing apparatus of claim 1, wherein the reflectivity value is based on a number of the photons transmitted from the optical sensor and a number of photons received back at the optical sensor per unit time.

13. The printing apparatus of claim 1, wherein the distance threshold is based on an opposing distance between the optical sensor and the surface facing the optical sensor.

14. A printing apparatus comprising:

a media bin, the media bin being laterally translatable between a retracted position and an extended position;

an optical sensor to detect a distance between the optical sensor and a surface facing the optical sensor while the media bin is in the extended position; and a controller to:

determine whether the media bin is considered empty based on the distance measured within a distance threshold;

determine whether a reflectivity value of the surface facing the optical sensor is within a reflectivity threshold; and laterally translate the media bin from the extended position to the retracted position when the reflectivity value is determined to be within the reflectivity threshold.

15. The printing apparatus according to claim 14, wherein the reflectivity value of the surface facing the optical sensor is determined based on number of photons transmitted and reflected back at the optical sensor per unit time.

16. The printing apparatus according to claim 14, wherein the reflectivity threshold is based on a reflectivity value of an opposing surface of the media bin.

17. A method comprising:

determining a distance between an optical sensor and a surface facing the optical sensor;

determining whether the distance is within a distance threshold, wherein the distance threshold is based on a distance between the optical sensor and an opposing side of a media bin facing the optical sensor;

in response to the determined distance being within the distance threshold, determining a reflectivity value of the surface facing the optical sensor, wherein the reflectivity value is based on a number of photons transmitted and reflected back at the optical sensor per unit time; and raising an alert based on the reflectivity value.

18. The method of claim 17, wherein the distance threshold is a percentage of the distance between the optical sensor and the opposing side of the media bin facing the optical sensor.

19. The method of claim 17, wherein the determining the distance between the optical sensor and the surface facing the optical sensor includes utilizing a range gated imager.

20. The method of claim 17, comprising determining whether at least one print media is on the media bin based on the reflectivity value.

* * * * *